US005934201A

United States Patent [19]

Diffrient

[11] Patent Number: 5,934,201

[45] Date of Patent: Aug. 10, 1999

[54] TABLE WITH WIRE MANAGER

[75] Inventor: Niels Diffrient, Ridgefield, Conn.

[73] Assignee: Howe Furniture Corporation, Trumbull, Conn.

[21] Appl. No.: 08/956,914

[22] Filed: Oct. 23, 1997

[51] Int. Cl.[6] ..... A47B 35/00

[52] U.S. Cl. ..... 108/50.02

[58] Field of Search ..... 108/50.02; 312/223.6, 312/223.1

[56] References Cited

U.S. PATENT DOCUMENTS

| | | | |
|---|---|---|---|
| 4,433,630 | 2/1984 | Laborie | 108/50.02 |
| 5,103,741 | 4/1992 | Grund et al. | 312/223.6 X |
| 5,231,562 | 7/1993 | Pierce et al. | 108/50.02 X |
| 5,237,935 | 8/1993 | Newhouse et al. | 108/50.02 |
| 5,277,131 | 1/1994 | Fortsch | 108/50.02 |
| 5,606,920 | 3/1997 | Meyer et al. | 108/50.02 |
| 5,640,912 | 6/1997 | Diffrient | 108/50.02 |
| 5,660,120 | 8/1997 | Sims | 108/50.02 X |
| 5,673,632 | 10/1997 | Sykes | 108/50.02 X |

OTHER PUBLICATIONS

Nucraft Furniture Company Catalog, Sep. 1997.

*Primary Examiner*—José V. Chen

*Attorney, Agent, or Firm*—Ware, Fressola, Van der Sluys & Adolphson LLP

[57] ABSTRACT

A folding table has a top which is supported on two C-leg assemblies. Extending beneath the top and along its back edge is a wire tray having an access door accessible from beneath the table top. The vertical leg portion of at least one of the two C-leg assemblies carries a tubular wire housing having a vertical access opening. The opening is closed by the projecting flap portion of an elongated resilient member which is clamped between the vertical leg portion and the housing.

11 Claims, 5 Drawing Sheets

TABLE WITH WIRE MANAGER

BACKGROUND OF THE INVENTION

1. Technical Field

The present invention falls within the field of office furniture, more particularly, tables and desks.

2. Description of the Prior Art

With the proliferation of computers and other electronic devices in the modern workplace, it has become important to manage and channel the wiring for such devices. The reduction of "wire clutter" is important for a number of reasons including safety, ease of maintenance, cleanliness, and aesthetics. It is not unusual for office tables to include wire managers in the form of horizontal trays underlying the table top. See, for example, the following United States Patents of the present inventor: U.S. Pat. Nos. 4,827,851; 5,337,657; and 5,640,912. One problem with most of these systems is that the wire manager, or tray, is accessible only from the outside of the table. If the table is positioned against a wall, for example, it must be moved before the tray can be accessed.

It is also known in prior art tables to provide a vertical wire manager along the table leg. A number of approaches to achieving this result have been attempted. These include providing recesses in the legs themselves, the recesses being closed by flexible covers or by removable U-shaped covers. This results in increased complexity of manufacture, an undesirable proliferation of parts, and unappealing aesthetics. Furthermore, it would be desirable for such a leg-mounted housing to communicate with the horizontal wire tray.

Accordingly, it is a primary object of the present invention to provide a wire manager system for a table which includes a wire tray accessible from underneath the table. Other objects are to provide such a table having a leg-mounted wire housing adapted to communicate with the horizontal tray and closure means on the vertical housing permitting wire access at any along its length, to provide a housing and closure that aesthetically complements the shape of the table leg, and that is of simple construction. The manner in which these objects are achieved will be apparent from the following description and appended claims.

SUMMARY OF INVENTION

The invention comprises a table having a horizontal wire tray that extends along and below the edge of the table top, having a door accessible from beneath the table top. The table also includes a wire housing secured to, and extending along, the vertical leg of the table and having a resilient access flap extending along substantially the entire length of the leg.

BEST MODE FOR CARRYING OUT THE INVENTION

Figure 1:
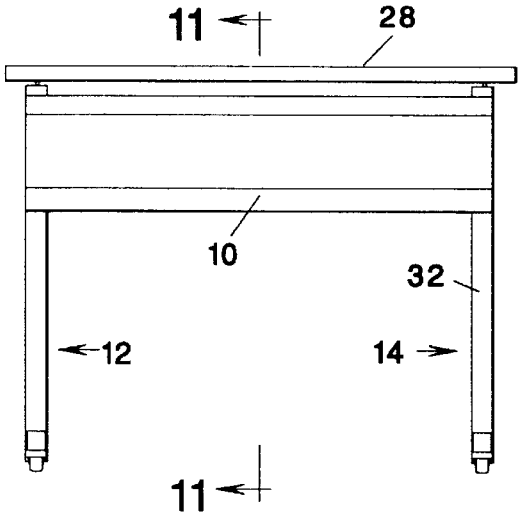
FIG. 1 is a front elevational view of a table in accordance with the present invention.
Figure 2:
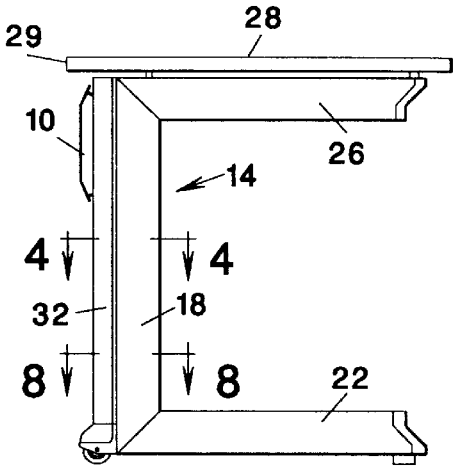
FIG. 2 is a right end view of the table of FIG. 1.

With particular reference to FIGS. 1 and 2, there is illustrated a foldable table having a face panel 10. The table is of conventional construction, having a beam (not shown) to the ends of which are hingedly mounted a left C-leg assembly 12 and a right C-leg assembly 14. (For further details of the table construction, reference may be had to U.S. Pat. No. 5,337,657 of the present inventor, which is hereby incorporated by reference.) The C-leg assemblies are substantially identical, although reversed. Each includes a vertical leg member 16 (FIG. 11), 18. Each also includes a horizontal foot member 20, 22 and a horizontal top support member 24, 26. When the table is in its illustrated erected position, the top support arms 24, 26 carry resting thereon the table top 28. The structure thus far described is conventional and does not form a part of the present invention.

Figure 4:
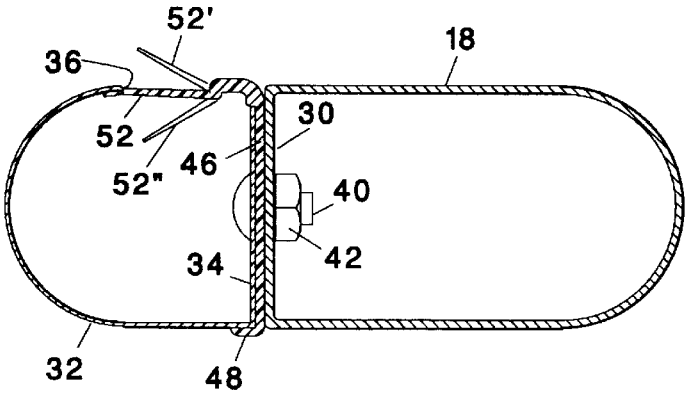
FIG. 4 is an enlarged cross section taken substantially along the line 4—4 of FIG. 2.

In view of the fact that the C-leg assemblies 12, 14 are identical although reversed, reference to an element or part of such assembly is to be understood as referring to and including the similar part or element on the other. Looking now to FIG. 4, the vertical leg member 18 will be seen to comprise a tube having a substantially semi-oval cross section and a flat side 30. This flat side extends the entire vertical length of the leg member 18.

Mounted on the leg member 18 is a wire housing 32. The wire housing 32 is also in the form of a tube and has a configuration which, in cross section, substantially duplicates that of the vertical leg member 18, including a flat side 34. However, the tube is not completely closed, thereby defining a vertical opening bounded by an edge 36 adjacent the curved portion of the housing 32, and an edge 38 along the flat side 34. The flat side 34 of the housing 32 is secured to the flat side 30 of the leg member 18 by means of bolts 40 and nuts 42. However, interposed between the facing surfaces of the two flat sides is an elongated resilient member 44. The resilient member 44 may be extruded of vinyl, for example, and preferably, but not necessarily, is cut to a length to run the entire length of the vertical leg member 18.

Figure 3:
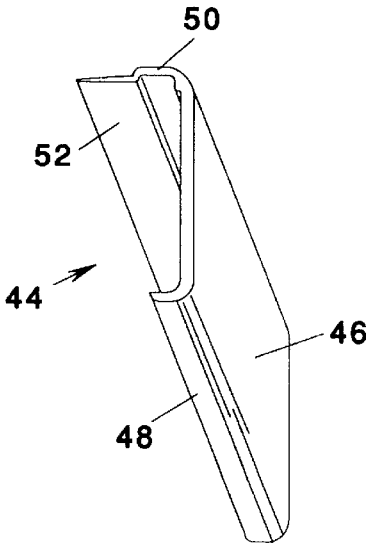
FIG. 3 is a perspective view of a resilient closure member forming a part of this invention.

A portion of the resilient member 44 is illustrated in FIG. 3. As will be seen therein, resilient member 44 is essentially C-shaped and includes a flat rectangular body 46 which is interposed between the flat side 30 of leg member 18 and the flat side 34 of housing 32. Along one edge of the body 46 is an extension 48 which extends outwardly at a 90° angle. When the body 46 is clamped between the leg member and the housing, extension 48, which may be of a contrasting color to the table, forms a decorative stripe. The opposite edge of the body 46 also curves inwardly by 90° and takes the form of a relatively heavy bead 50 from which extends a tapered flap 52. The flap 52 closes the opening defined by the edges 36, 38 of the housing 32. However, the flap 52 is easily displaced, as indicated by the phantom lines of FIG. 4, to positions 52' or 52" whereby wires are permitted to enter or leave the housing 32. The relatively heavy bead 50 serves as a hinge for the flap 52.

Figure 6:
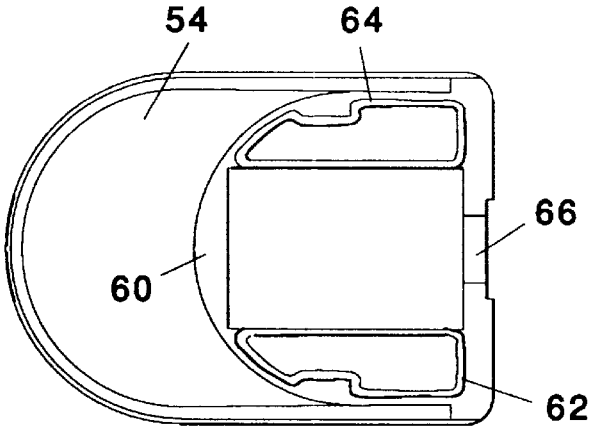
FIG. 6 is a top view of the housing of FIG. 5.
Figure 5:
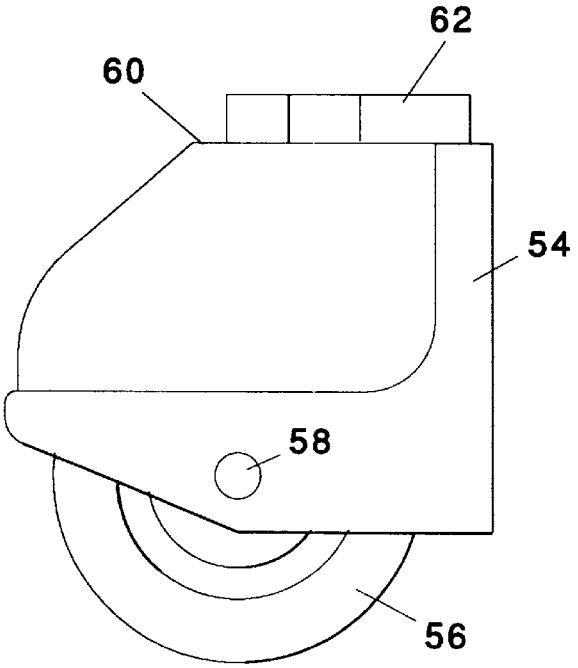
FIG. 5 is a side view of a roller and housing usable with the present invention.
Figure 7:
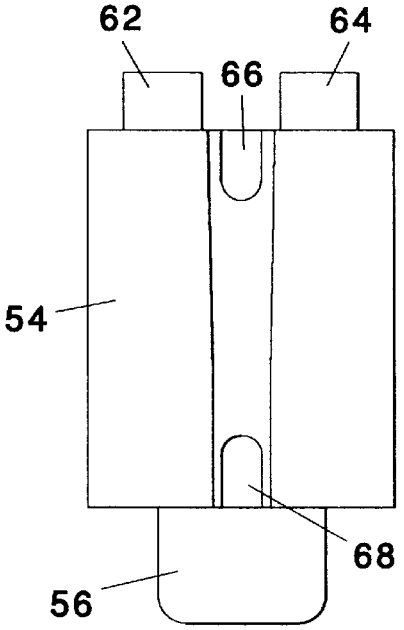
FIG. 7 is a right end view of the roller and housing of FIG. 5.

In one configuration of the table of this invention, a lower end of each leg terminates in a housing 54 as illustrated in FIGS. 5–7. The housing encloses a roller 56 mounted on an axle 58. A relatively flat upper surface 60 of the roller housing has a shape corresponding to the cross section of the wire housing 32 and is surmounted by a pair of projections 62, 64 which are shaped to fit the inside surface of the housing 32. A recess 65 extends into the housing between the projections 62, 64. The rear surface of the roller housing 54 further defines a pair of mounting slots 66, 68 which extend into the recess 65.

Figure 8:
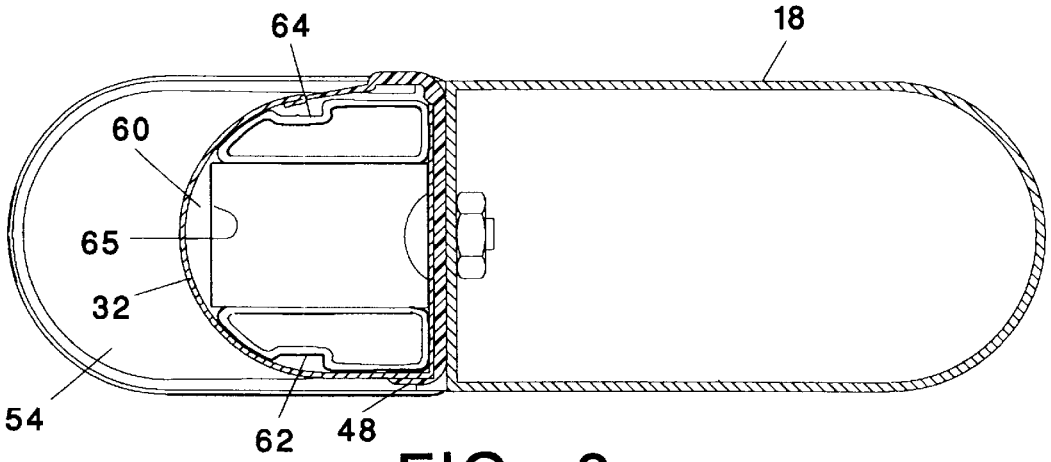
FIG. 8 is an enlarged cross section taken substantially along the line 8—8 of FIG. 2.
Figure 9:
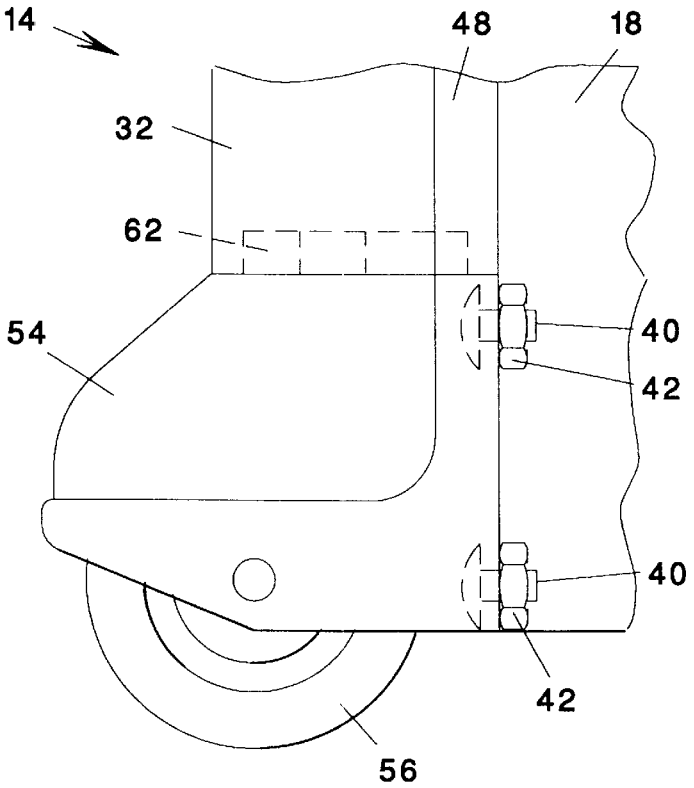
FIG. 9 is a side view, partially broken away, of the leg and housing of FIG. 8.
Figure 10:
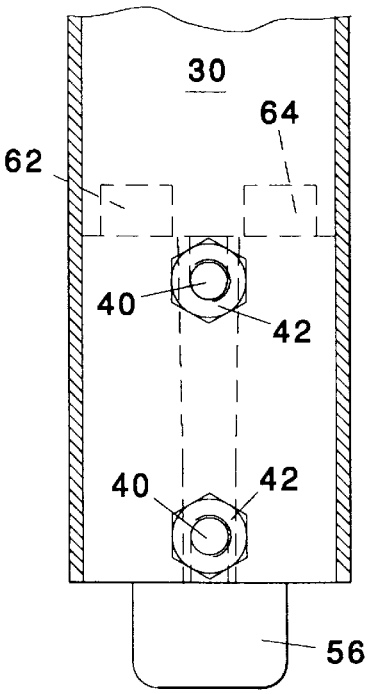
FIG. 10 is a right end view of the leg and roller housing of FIG. 9.

The connection of the roller housing 54 to the C-leg assembly 14 is illustrated most clearly in FIGS. 8–10 which also detail the bolts 40 and nuts 42 which lock the elements together.

As clearly shown therein, the end of the wire housing 32 fits snugly over the projections 62, 64 and rests against the upper surface 60. The bolts 40 extend from the recess 65 through the mounting slots 66,68 and into the vertical leg member 18 where they are secured by the nuts 42.

Figure 11:
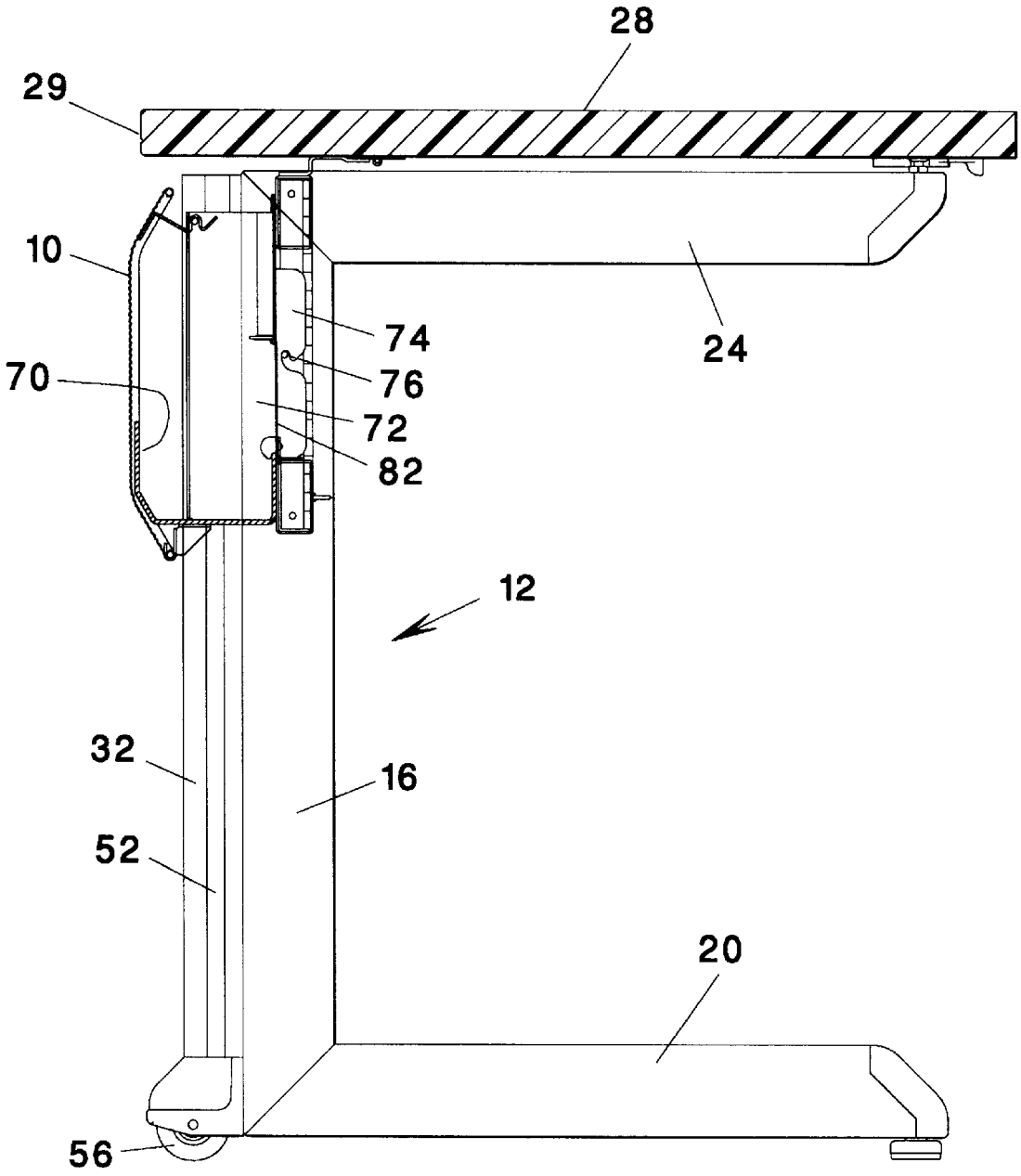
FIG. 11 is an enlarged cross section taken substantially along the line 11—11 of FIG. 1.
Figure 12:
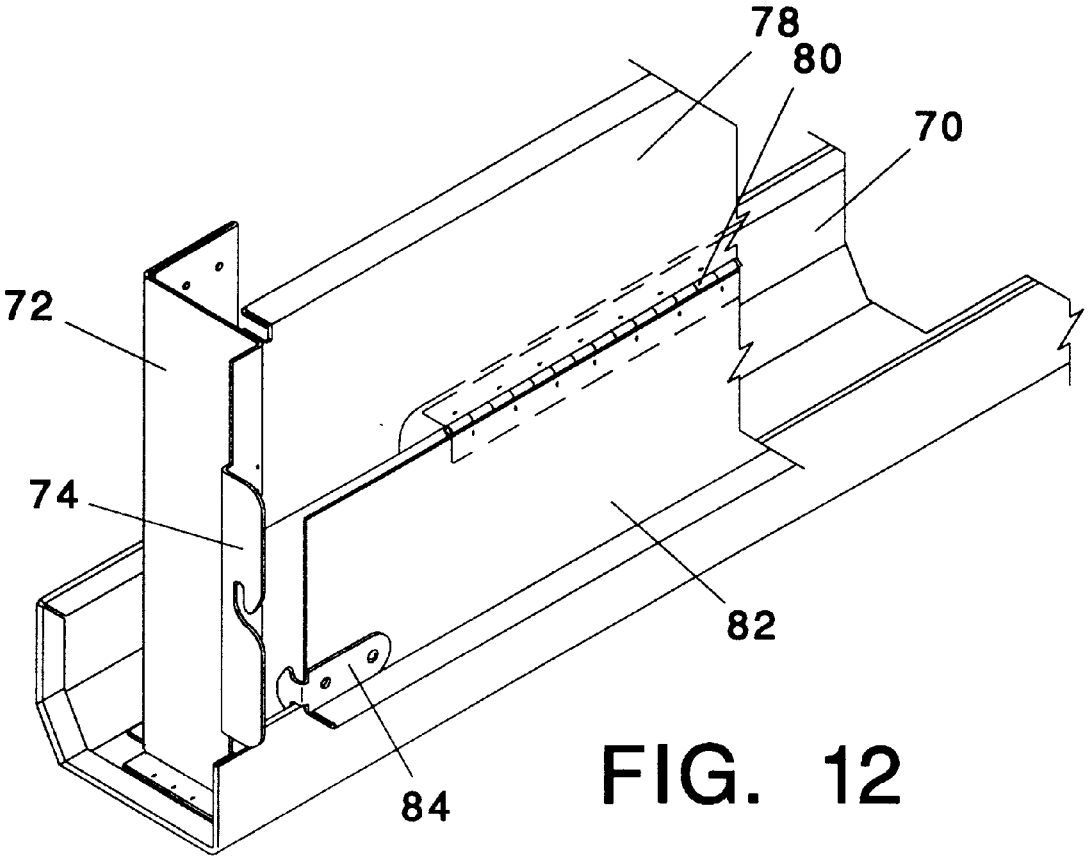
FIG. 12 is a perspective view of the horizontal wire manager and access door.

The cross section of FIG. 11 and the enlarged detail of FIG. 12 illustrate the horizontal wire tray 70 which extends along the length of the table top 28 beneath its back edge 29. The tray 70 is suspended from end brackets 72 from which extend hooks 74 which hang upon pins 76 carried by each of the C-leg assemblies. A wall member 78 (FIG. 12) extends between the wall brackets 72 at either end of the wire tray 70. The wall 78 does not extend all the way to the bottom of the bracket 72. Rather, as illustrated in FIG. 12, the wall 78 is relatively narrow carries along its lower edge a piano hinge 80. Suspended by the piano hinge 80 is an access door 82. The access door 82 opens into the region below the table top 28 and is locked closed by a latch 84 at the end of the door. This access door 82 allows wires to be placed into, or removed from, the tray 70 even when the table is positioned with its back table edge 29 against a wall.

It is believed that the many advantages of this invention will now be apparent to those skilled in the art. It will also be apparent that a number of variations and modifications can be made therein without departing from its spirit and scope. Accordingly, the foregoing description is to be construed as illustrative only, rather than limiting. This invention is limited only by the scope of the following claims.

I claim:

1. In a table comprising a substantially horizontal top having at least one edge and at least one substantially vertical leg, the improvement which comprises:

a wiring tray extending along said edge beneath said top, said wiring tray having an access door thereto accessible from beneath said top;

a housing secured to, and extending along a major portion of the length of, said leg and defining an elongated wire-receiving opening, the housing including at least one side substantially conforming to said leg; and an elongated resilient member secured between the conforming side of said housing and said leg, said resilient member including a flap extending outwardly from the conforming side of said housing and normally closing said wire-receiving opening but displaceable to permit wires to enter or exit said housing, whereby any one of said wires may be housed within both of said tray and housing.

2. The improvement of claim 1, wherein both of said leg and said housing are tubular and have external substantially planar conforming facing surfaces separated by said resilient member.

3. The improvement of claim 2, wherein said resilient member is substantially C-shaped in cross-section and comprises:

a substantially rectangular body portion separating said substantially planar facing surfaces and bounded on one edge by a bead from which said flap extends; and an extension bounding a second, opposite, edge of the resilient member and forming a stripe between said vertical leg and said housing.

4. The improvement of claim 3, wherein each of said tubular leg and housing is substantially semi-oval in cross-section.

5. In a table comprising a substantially horizontal top having at least one edge and at least one substantially vertical leg, the improvement which comprises:

a housing secured to, and extending along a major portion of the length of, said leg and defining an elongated wire-receiving opening, the housing including at least one side substantially conforming to said leg; and an elongated resilient member secured between the conforming side of said housing and said leg, said resilient member including a flap extending outwardly from the conforming side of said housing and normally closing said wire-receiving opening but displaceable to permit wires to enter or exit said housing.

6. The improvement of claim 5, wherein both of said leg and said housing are tubular and have external substantially planar conforming facing surfaces separated by said resilient member.

7. The improvement of claim 6, wherein said resilient member is substantially C-shaped in cross-section and comprises:

a substantially rectangular body portion separating said substantially planar facing surfaces and bounded on one edge by a bead from which said flap extends; and an extension bounding a second, opposite, edge of the resilient member and forming a stripe between said vertical leg and said housing.

8. The improvement of claim 7, wherein each of said tubular leg and housing is substantially semi-oval in cross-section.

9. In a folding table comprising a substantially horizontal top having at least one edge and at least two hingedly mounted leg assemblies providing at least two substantially vertical legs, the improvement which comprises:

a wiring tray removably supported extending along said edge beneath said top by interengagement between respective first and second ends of the wiring tray and the at least two substantially vertical legs, said wiring tray having an access door between said first and second ends and accessible from beneath said top.

10. The improvement of claim 9 wherein a support wall extends along at least a portion of the length of said wiring tray and said access door is hingedly connected to said support wall.

11. The improvement of claim 9, wherein the at least two vertical legs each have at least one pin extending therefrom, and the first and second ends of the wiring tray each define a hook which hangs upon the pin of the adjacent vertical leg to support the wiring tray between the at least two vertical legs.

* * * * *